US010155391B2

(12) United States Patent
Yokoo et al.

(10) Patent No.: US 10,155,391 B2
(45) Date of Patent: Dec. 18, 2018

(54) FLOW PATH MEMBER AND LIQUID EJECTING APPARATUS

(71) Applicant: SEIKO EPSON CORPORATION, Tokyo (JP)

(72) Inventors: Ayumi Yokoo, Matsumoto (JP); Hirokazu Ono, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/276,648

(22) Filed: Sep. 26, 2016

(65) Prior Publication Data

US 2017/0087836 A1 Mar. 30, 2017

(30) Foreign Application Priority Data

Sep. 29, 2015 (JP) ..... 2015-190941

(51) Int. Cl.
*B41J 2/175* (2006.01)
*B41J 2/14* (2006.01)

(52) U.S. Cl.
CPC ..... *B41J 2/175* (2013.01); *B41J 2/1433* (2013.01); *B41J 2/17596* (2013.01); *B41J 2002/14306* (2013.01)

(58) Field of Classification Search
CPC ..... B41J 2/175; B41J 2/17596; B41J 2002/14306; B41J 2/1433
See application file for complete search history.

(56) References Cited

U.S. PATENT DOCUMENTS 7,090,341 B1 * 8/2006 Miyazawa ..... B41J 2/17503 137/852
8,113,612 B2 * 2/2012 Levy ..... B41J 2/175 347/19
2004/0196341 A1 * 10/2004 Ogura ..... B41J 2/17513 347/86
2006/0152563 A1 * 7/2006 Kumagai ..... B41J 2/17596 347/86
2007/0277927 A1 * 12/2007 Momose ..... B29C 65/1696 156/272.8
2008/0033377 A1 * 2/2008 Kauth ..... A61F 13/00987 604/304
2010/0200486 A1 * 8/2010 Gunther ..... A61M 1/16 210/188
2010/0220127 A1 * 9/2010 Levy ..... B41J 2/175 347/6

FOREIGN PATENT DOCUMENTS

| | | |
|---|---|---|
| JP | 2008-143081 | 6/2008 |
| JP | 2010-214845 | 9/2010 |
| JP | 2012-171343 | 9/2012 |
| JP | 2015-075146 | 4/2015 |
| WO | 2015-053108 | 4/2015 |

* cited by examiner

*Primary Examiner* — Yaovi M Ameh
(74) *Attorney, Agent, or Firm* — Workman Nydegger

(57) ABSTRACT

A flow path member includes a flow path forming member; an elastic film which forms a flow path in a state in which a peripheral edge portion is in close contact with the flow path forming member; and a cover member which surrounds an outer edge portion of the elastic film along with the flow path forming member.

18 Claims, 8 Drawing Sheets

FLOW PATH MEMBER AND LIQUID EJECTING APPARATUS

BACKGROUND

1. Technical Field

The present invention relates to a flow path member which is applied to an ink jet printer, or the like, and a liquid ejecting apparatus which includes the flow path member.

2. Related Art

In the related art, as an example of a liquid ejecting apparatus, an ink jet printer which prints characters or an image on a medium, by ejecting ink as an example of liquid onto the medium such as a sheet has been known. In such a liquid ejecting apparatus, there is an apparatus which is provided with a pressure buffer (flow path member), in order to stabilize a pressure of liquid from a liquid accommodating unit to a liquid ejecting unit, in the middle of a supply flow path of liquid from the liquid accommodating unit which accommodates liquid to the liquid ejecting unit which ejects liquid (for example, JP-A-2015-75146).

Here, the pressure buffer is provided with a pressure chamber which is formed of a housing with a recessed portion (flow path forming member), and a pressure buffering film (elastic film) which covers the recessed portion. In addition, in a case in which a pressure in a region which is communicated with the pressure chamber is going to be changed, the pressure buffer stabilizes a pressure of liquid supplied to a liquid ejecting unit, by displacing the pressure buffering film so as to suppress the change.

Incidentally, in the above described pressure buffer, the housing and the pressure buffering film are welded by using heat which is generated by irradiation of a laser. For this reason, there is a case in which a film thickness of the pressure buffering film at a portion welded together with the housing becomes non-uniform, at a time of performing welding between the housing and the pressure buffering film. In this case, there is a concern that liquid may leak from the pressure buffer, when a portion of the pressure buffering film with a small film thickness progresses, and is changed over time. As a result, there is a concern that liquid may spread inside the liquid ejecting apparatus.

SUMMARY

An advantage of some aspects of the invention is to provide a flow path member which can suppress leaking of liquid, and a liquid ejecting apparatus which is provided with the flow path member.

Hereinafter, means of the invention, and operational effects thereof will be described.

According to an aspect of the invention, there is provided a flow path member which is provided with a flow path forming member; an elastic film which forms a flow path in a state in which a peripheral edge portion is in close contact with the flow path forming member; and a cover member which surrounds an outer edge portion of the elastic film along with the flow path forming member.

According to the configuration, since the outer edge portion of the elastic film is surround with the flow path forming member and the cover member in the flow path member, it is possible to suppress leaking of liquid to the outside of the flow path member, even when the liquid leaks from a flow path through a portion in which the flow path forming member and the peripheral edge portion of the elastic film are in close contact.

In the flow path member, it is preferable that a plurality of the elastic films are provided, the plurality of elastic films form a plurality of flow paths, in a state in which respective peripheral edge portions are in close contact with the flow path forming member, individually, and the cover member surrounds the outer edge portions of the plurality of elastic films, individually, along with the flow path forming member.

According to the configuration, it is possible to provide a plurality of flow paths on which liquid flows, using a single flow path forming member and a single cover member. Meanwhile, it is possible to individually position the plurality of elastic films with respect to the flow path forming member, by providing the plurality of elastic films. That is, it is possible to increase positioning accuracy of the elastic film with respect to the flow path forming member.

In the flow path member, it is preferable to further include a press member which presses the elastic film toward the flow path forming member.

According to the configuration, it is possible to cause the elastic film and the flow path forming member to be in close contact using the press member. For this reason, it is not necessary to bond the elastic film and the flow path forming member using heat welding, adhesion, or the like.

In the flow path member, it is preferable that the press member surrounds the outer edge portion of the elastic film along with the flow path forming member and the cover member, the flow path forming member and the cover member are bonded, and the press member and the cover member are bonded.

According to the configuration, the outer edge portion of the elastic film is surrounded with the cover member, the flow path forming member, and the press member. In addition, the cover member and the flow path forming member are bonded to each other, and the cover member and the press member are bonded to each other. For this reason, even when liquid is about to leak from the outer edge portion of the elastic film, a leakage destination of the liquid is closed by the flow path forming member, the cover member, and the press member. In this manner, it is possible to further suppress leaking of liquid to the outside of the flow path member.

In the flow path member, it is preferable that the cover member includes a pressing portion which presses the elastic film toward the flow path forming member.

According to the configuration, it is possible to cause the elastic film and the flow path forming member to be in close contact using the pressing portion of the cover member. For this reason, it is not necessary to bond the elastic film and the flow path forming member using heat welding, adhesion, or the like. In addition, it is possible to make a configuration of the flow path member simple, compared to a case in which the press member is separately provided, since the pressing portion is provided in the cover member.

In the flow path member, it is preferable that at least one of the flow path forming member and the cover member is transparent.

According to the configuration, it is possible to view the outer edge portion, by seeing through at least one of the flow path forming member and the cover member which surround the outer edge portion of the elastic film. For this reason, it is possible to observe whether or not liquid leaks from the outer edge portion of the elastic film from the outside of the flow path member.

According to another aspect of the invention, there is provided a liquid ejecting apparatus which includes a liquid ejecting unit which ejects liquid, and a liquid supplying flow path which supplies liquid to the liquid ejecting unit, in which the liquid supplying flow path includes any one of the above described flow path members.

According to the configuration, it is possible to obtain an operational effect which is exerted by the above described flow path member in the liquid ejecting apparatus.

It is preferable that the liquid ejecting apparatus further includes a detecting unit which detects leaking of liquid from the outer edge portion of the elastic film.

According to the configuration, it is possible to cause the detecting unit to detect leaking of liquid. As a result, for example, it is possible to cause a user of the liquid ejecting apparatus, or the liquid ejecting apparatus itself to perform an operation for counteracting leaking of liquid, or the like.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, an embodiment of a liquid ejecting apparatus will be described with reference to drawings. The liquid ejecting apparatus according to the embodiment is an ink jet printer which forms characters or an image on a medium, by ejecting ink as an example of liquid onto the medium M such as a sheet.

Figure 1:
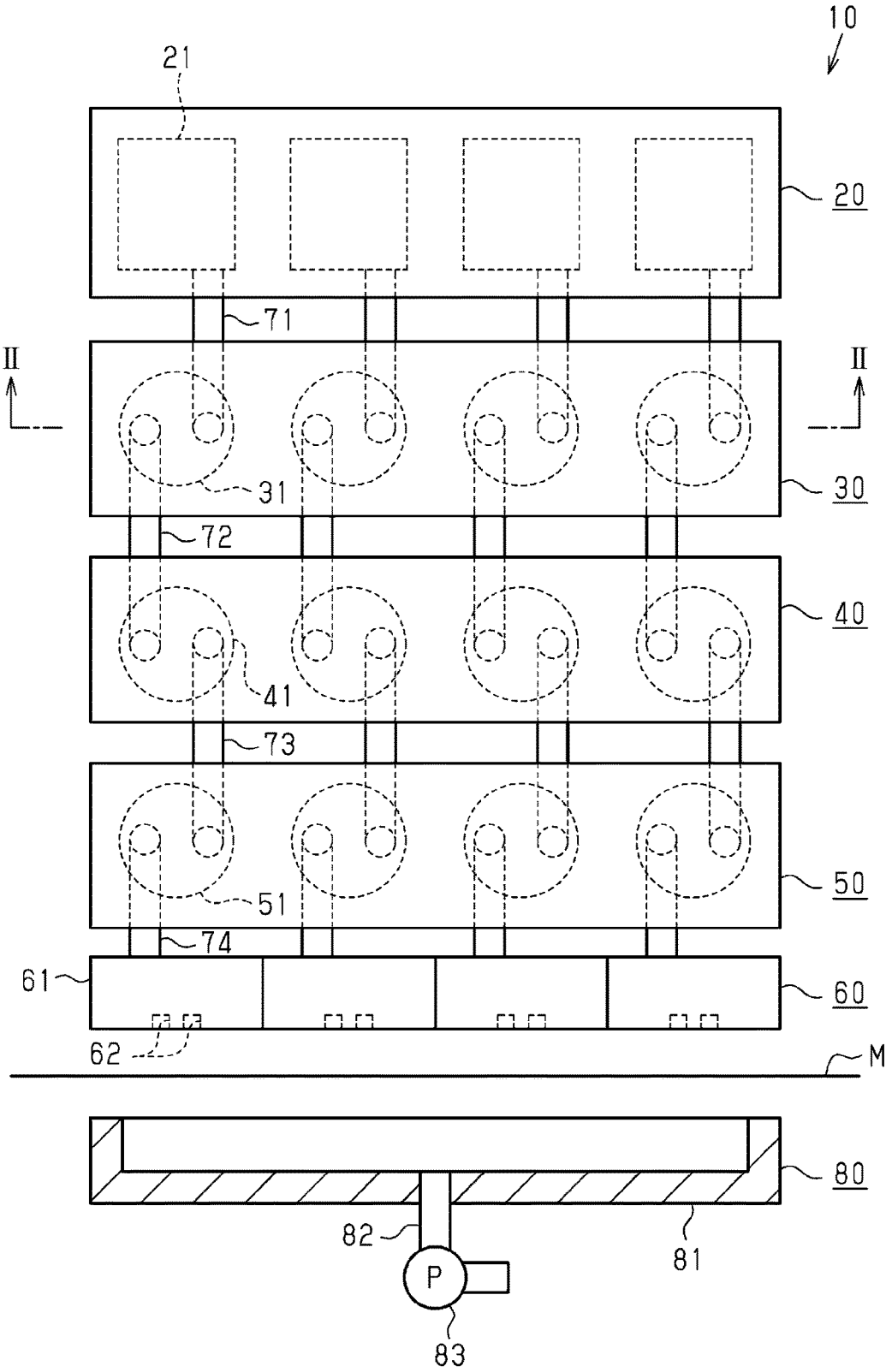
FIG. 1 is a schematic view of a liquid ejecting apparatus according to an embodiment.

As illustrated in FIG. 1, a liquid ejecting apparatus 10 is provided with a liquid storage unit 20 which stores liquid, a supply regulating unit 30 which regulates or permits supplying of liquid, a pressure buffering unit 40 which suppresses a fluctuation in a supply pressure of liquid, a pressure adjusting unit 50 which adjusts the supply pressure of liquid, and a liquid ejecting unit 60 which ejects liquid, along a direction in which liquid flows.

The liquid ejecting apparatus 10 is provided with a first flow path 71 which connects the liquid storage unit 20 and the supply regulating unit 30, and a second flow path 72 which connects the supply regulating unit 30 and the pressure buffering unit 40. In addition, the liquid ejecting apparatus 10 is provided with a third flow path 73 which connects the pressure buffering unit 40 and the pressure adjusting unit 50, a fourth flow path 74 which connects the pressure adjusting unit 50 and the liquid ejecting unit 60, and a maintenance unit 80 which performs maintenance of the liquid ejecting unit 60.

In the following descriptions, an "upstream side" and a "downstream side" will be referred to according to a direction in which liquid flows. That is, in the liquid ejecting apparatus 10, it can be said that the liquid storage unit 20 is provided on the uppermost stream side, and the liquid ejecting unit 60 is provided on the lowermost stream side.

As illustrated in FIG. 1, the liquid storage unit 20 is provided with a plurality of (four in embodiment) liquid storage sections 21 which accommodate liquid of a different type, respectively. Upstream ends of the plurality of first flow paths 71 are respectively connected to the plurality of liquid storage section 21. In addition, the liquid storage unit 20 supplies liquid which is stored in the plurality of liquid storage sections 21 toward the downstream side in a pressurizing manner, by driving a pressurizing mechanism which is not illustrated (for example, diaphragm pump).

The supply regulating unit 30 is provided with a plurality of (four in embodiment) supply regulating sections 31 which can respectively regulate supplying of liquid which is supplied from the plurality of liquid storage sections 21 to the downstream side. Downstream ends of the plurality of first flow paths 71, and upstream ends of the plurality of second flow paths 72 are respectively connected to the plurality of supply regulating sections 31.

In the following descriptions, a state in which supplying of liquid to the downstream side using the supply regulating section 31 is regulated is also referred to as a "supply regulating state", and a state in which supplying of liquid to the downstream side using the supply regulating section 31 is permitted is also referred to as a "supply permitting state".

The pressure buffering unit 40 is provided with a plurality of (four in embodiment) pressure buffering sections 41 which respectively suppress a pressure fluctuation of liquid which is supplied from the plurality of supply regulating sections 31. Downstream ends of the plurality of second flow path 72, and upstream ends of the plurality of third flow paths 73 are respectively connected to the plurality of pressure buffering sections 41.

The pressure adjusting unit 50 is provided with a plurality of (four in embodiment) pressure adjusting sections 51 which respectively adjust a pressure of liquid which is supplied from the plurality of pressure buffering sections 41. Downstream ends of the plurality of third flow paths 73, and upstream ends of the plurality of fourth flow paths 74 are respectively connected to the plurality of pressure adjusting sections 51. In addition, the pressure adjusting unit 50 adjusts a pressure of liquid which is supplied in a pressurizing manner from the pressure buffering unit 40 through the third flow path 73 to a pressure (negative pressure) which is less than an external pressure (for example, atmospheric pressure) of the pressure adjusting unit 50, and supplies thereof to the liquid ejecting unit 60 through the fourth flow path 74.

The liquid ejecting unit 60 is provided with a plurality of (four in embodiment) liquid ejecting sections 61 which respectively eject liquid which is supplied from the plurality of pressure adjusting section 51. A plurality of nozzles 62 which eject liquid are open to the liquid ejecting section 61.

In addition, downstream ends of the plurality of fourth flow paths 74 are respectively connected to the plurality of liquid ejecting sections 61.

For example, in a case in which the liquid ejecting apparatus 10 is an ink jet printer, printing is performed when ink of a plurality of types (for example, cyan, magenta, yellow, and black) are respectively ejected from the plurality of liquid ejecting sections 61 toward the medium M.

According to the embodiment, liquid which is stored in a certain liquid storage section 21 is supplied to the liquid ejecting section 61 through the first flow path 71, the supply regulating section 31, the second flow path 72, the pressure buffering section 41, the third flow path 73, the pressure adjusting section 51, and the fourth flow path 74. In such a point, according to the embodiment, the first flow path 71, the supply regulating section 31, the second flow path 72, the pressure buffering section 41, the third flow path 73, the pressure adjusting section 51, and the fourth flow path 74 correspond to one example of the "liquid supplying flow path" through which liquid is supplied to the liquid ejecting section 61. According to the embodiment, in the above described liquid supplying flow path, un upstream side of the pressure adjusting section 51 is set to a positive pressure, and a downstream side of the pressure adjusting section 51 is set to a negative pressure.

The maintenance unit 80 is provided with a cap 81 which is open toward the liquid ejecting unit 60, a suctioning flow path 82 which is connected to the cap 81, and a suctioning pump 83 which is provided in the middle of the suctioning flow path 82. The cap 81 moves in a direction approaching the liquid ejecting section 61, or in a direction separated from the liquid ejecting section 61 due to driving of an elevating mechanism which is not illustrated.

The maintenance unit 80 performs "capping" in which a space to which a nozzle 62 of the liquid ejecting section 61 is open is set to a closed space using the cap 81, by raising the cap 81. The capping is performed in order to prevent a solvent component in ink in the liquid ejecting section 61 from evaporating from the nozzle 62.

The maintenance unit 80 performs "cleaning" in which liquid is forcibly discharged from the nozzle 62, by setting the closed space to which the nozzle 62 of the liquid ejecting section 61 is open to a negative pressure, by driving the suctioning pump 83 in a state in which the capping is performed. Cleaning is performed in order to restore an ejecting failure, in a case in which the ejecting failure occurs in the nozzle 62 of the liquid ejecting section 61.

In a case in which cleaning is performed, the supply regulating section 31 may be set to a supply regulating state, and may be set to a supply permitting state, after a negative pressure in the closed space becomes is increased. In this case, it is possible to efficiently discharge bubbles, or the like, which are caught on an inner wall of a flow path, by setting a flow rate of liquid which flows on the downstream side of the supply regulating section 31 to be large compared to a case of performing normal cleaning. In the following descriptions, cleaning in which liquid is caused to vigorously flow on the flow path by increasing a negative pressure in the closed space in a state in which flowing of liquid is limited, and then permitting flowing of liquid is also referred to as "choke cleaning".

Subsequently, a configuration related to the supply regulating unit 30 will be described in detail with reference to FIGS. 2 and 3.

Figure 2:
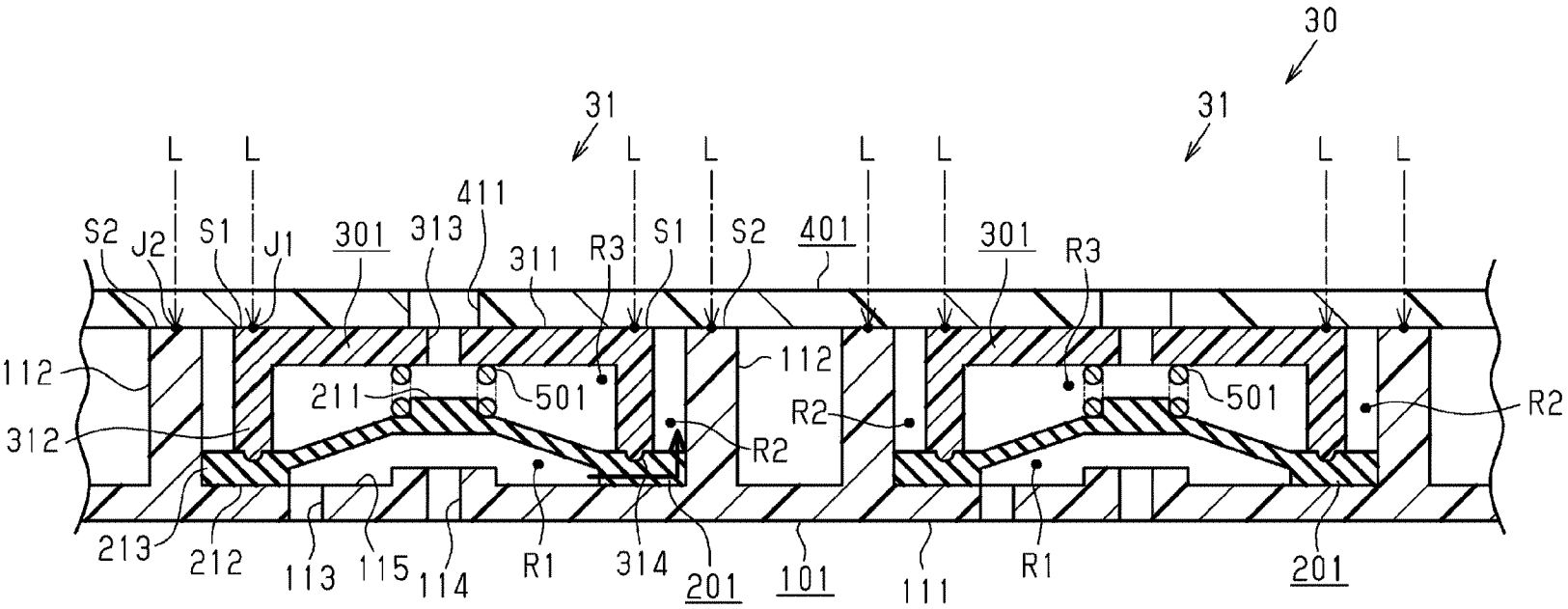
FIG. 2 is a sectional view which is cut along line II-II in FIG. 1.
Figure 3:
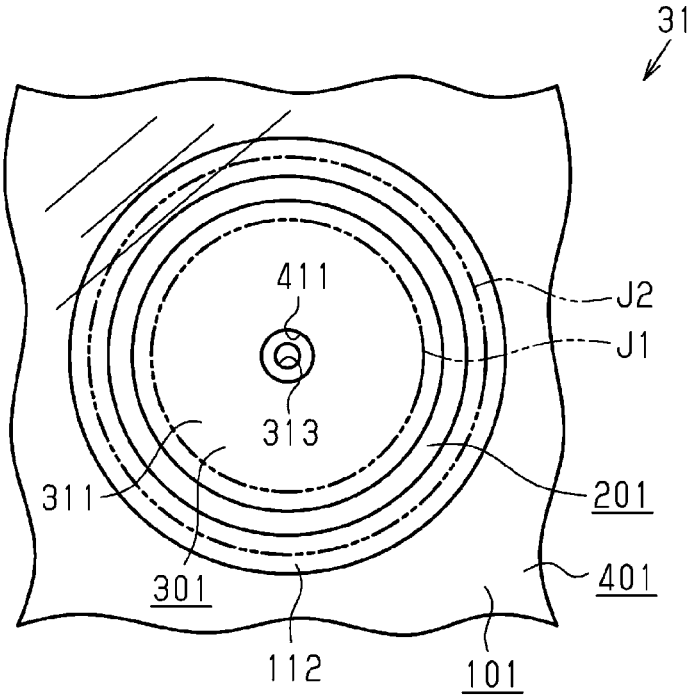
FIG. 3 is a partial plan view of the supply regulating unit.

As illustrated in FIGS. 2 and 3, the supply regulating unit 30 includes a flow path forming member 101 which configures a base portion, a plurality of elastic films 201 which can be elastically deformed, a plurality of press members 301 which press the plurality of elastic films 201 toward the flow path forming member 101, respectively, and a cover member 401 which covers the flow path forming member 101. In addition, the supply regulating unit 30 includes a plurality of coil springs 501 (an example of urging member) which urge the plurality of elastic films 201, respectively. Here, the elastic film 201, the press member 301, and the coil springs 501 are provided as many as the number of the supply regulating sections 31 (four in embodiment).

The flow path forming member 101 includes a base wall 111 which is formed in an approximately rectangular plate shape, and a plurality of peripheral walls 112 which are erected from the base wall 111, and are formed in an annular shape. In addition, an inflow port 113 to which a downstream end of the first flow path 71 is connected, and an outflow port 114 to which un upstream end of the second flow path 72 is connected are formed in the flow path forming member 101. The inflow port 113 and the outflow port 114 are open to a recessed portion 115 which is surrounded with the base wall 111 and the peripheral wall 112.

The elastic film 201 is formed in an approximately circular shape when viewed planarly, and an outer diameter thereof is set to be approximately the same as an inner diameter of the peripheral wall 112 of the flow path forming member 101. It is preferable to form the elastic film 201 using a rubber material with an excellent gas barrier property such as isobutylene-isoprene rubber. In addition, in the elastic film 201, a center portion 211 can be elastically deformed in the thickness direction with respect to a peripheral edge portion 212. Here, the peripheral edge portion 212 is a portion which is an outer portion in a radial direction of the elastic film 201, and is formed in a flange shape.

The press member 301 includes a base wall 311 which is formed in an approximately disk shape, and a peripheral wall 312 which is erected from a peripheral edge of the base wall 311. A through hole 313 is formed in the thickness direction of the base wall 311 at a center of the base wall 311, and a protrusion portion 314 is formed in a protruding manner over a peripheral direction, on a tip end face of the peripheral wall 312 in an erecting direction.

The cover member 401 is formed in an approximately rectangular shape, similarly to the base wall 111 of the flow path forming member 101. A plurality of through holes 411 corresponding to the through hole 313 of the press member 301 are formed in the cover member 401.

The flow path forming member 101, the press member 301, and the cover member 401 may be formed of a resin material, for example. Among these, it is preferable to form the flow path forming member 101 using a material with an excellent gas barrier property, similarly to the elastic film 201. According to the embodiment, among the flow path forming member 101, the press member 301, and the cover member 401, the flow path forming member 101 and the press member 301 are formed so as to be opaque in order to absorb visible light, and the cover member 401 is formed so as to be transparent in order to transmit visible light. Here, transparency means a state in which, when viewing a transparent member, the other side is seen through the transparent member.

Subsequently, a manufacturing method of the supply regulating unit 30 will be described.

As illustrated in FIG. 2, in a case of manufacturing the supply regulating unit 30, the plurality of elastic films 201 are respectively accommodated in a plurality of the recessed portions 115 of the flow path forming member 101, and the plurality of coil springs 501 and the plurality of press members 301 are respectively disposed on the elastic film 201. Here, since an inner diameter of the recessed portion 115 and an outer diameter of the elastic film 201 (peripheral edge portion 212) are approximately the same, it is possible to increase a positioning accuracy of the elastic film 201 with respect to the flow path forming member 101. Subsequently, the cover member 401 is caused to be in contact with a tip end face of the flow path forming member 101 in an erecting direction of the peripheral wall 112, while pressing the press member 301 toward the elastic film 201 using the cover member 401.

Thereafter, the plurality of press members 301 and the cover member 401 are welded (bonded) by radiating laser light L toward a contact face S1 of the plurality of press members 301 and the cover member 401, from the cover member 401 side. That is, the plurality of press members 301 and the cover member 401 are welded (bonded) by causing the laser light L which penetrated the cover member 401 to be absorbed in the press member 301, and generating heat on the contact face S1.

The flow path forming member 101 and the cover member 401 are welded (bonded), by radiating the laser light L toward a contact face S2 of the plurality of peripheral walls 112 of the flow path forming member 101 and the cover member 401 from the cover member 401 side. That is, the flow path forming member 101 and the cover member 401 are welded (bonded) by causing the laser light L which penetrated the cover member 401 to be absorbed in the press member 301, and generating heat on the contact face S2.

In the following descriptions, the process in which the press member 301 and the cover member 401 are bonded is also referred to as a "first bonding process", and the process in which the flow path forming member 101 and the cover member 401 are bonded is also referred to as a "second bonding process". As denoted by a two-dot dashed line in FIG. 3, the laser light L is radiated so as to draw a circle. As a result, as denoted by black spots in FIG. 2, and as denoted by the two-dot dashed lines in FIG. 3, annular bonding portions J1 and J2 are generated. Here, the bonding portion J1 bonds the press member 301 and the cover member 401, and the bonding portion J2 bonds the flow path forming member 101 and the cover member 401.

Incidentally, a wavelength of the laser light L which is radiated in order to weld members may be set to approximately 800 nm to 1100 nm, for example. For this reason, in the cover member 401 which is set to be transparent, transmittance in a wavelength range of the laser light L is set to be high, and in the flow path forming member 101, the press member 301, and the elastic film 201 which are set to be opaque, absorptivity in the wavelength range of the laser light L is set to be high.

According to the embodiment, when "transmittance in a wavelength range of the laser light L is high", it is a state in which transmittance in a case in which the laser light L is radiated to a member with a thickness of 2.0 mm is 30% or more. In addition, when "absorptivity in a wavelength range of the laser light L is high", it is a state in which absorptivity in a case in which the laser light L is radiated to a member with a thickness of 2.0 mm is 90% or more.

The plurality of supply regulating sections 31 are formed in the supply regulating unit 30 which is constructed in this manner. A communicating chamber R1 which causes the inflow port 113 and the outflow port 114 of the flow path forming member 101 to communicate is formed by the flow path forming member 101, and the elastic film 201 in a state of being in close contact with the flow path forming member 101 in each of the supply regulating section 31. That is, in the supply regulating section 31, liquid which flows in from the inflow port 113 flows out from the outflow port 114 after flowing in the communicating chamber R1.

In this point, according to the embodiment, the supply regulating unit 30 (supply regulating section 31) corresponds to an example of a "flow path member", and the inflow port 113, the communicating chamber R1, and the outflow port 114 correspond to an example of a "flow path". In addition, according to the embodiment, since the plurality of elastic films 201 are provided, "a plurality of flow paths" are formed in a state in which the peripheral edge portions 212 of the plurality of elastic films 201 are in contact with the flow path forming member 101, respectively. The supply regulating section 31 is provided on the upstream side of the pressure adjusting section 51 which adjusts a pressure of liquid supplied to the downstream side to a negative pressure, and a pressure in the flow path of the supply regulating section 31 is normally set to a positive pressure.

In the plurality of supply regulating section 31, a sealing property of the communicating chamber R1 is secured, since the peripheral edge portion 212 of the elastic film 201 is pressed by the base wall 111 (recessed portion 115) of the flow path forming member 101 using the protrusion portion 314 of the press member 301.

In the following descriptions, as illustrated in FIG. 2, in the peripheral edge portion 212 of the elastic film 201, an outer portion in a radial direction rather than a portion which is in close contact with the flow path forming member 101 by being pressed by the press member 301 is also referred to as an "outer edge portion 213". A chamber which is formed by being surrounded with the base wall 111 and the peripheral wall 112 of the flow path forming member 101, the cover member 401 which is bonded to the peripheral wall 112 of the flow path forming member 101, and the base wall 311 and the peripheral wall 312 of the press member 301 which is bonded to the cover member 401 is also referred to as an "accommodating chamber R2".

Then, according to the embodiment, it can be said that the outer edge portion 213 of the elastic film 201 is accommodated in the accommodating chamber R2. In addition, it can be said that the outer edge portion 213 of the elastic film 201 is surrounded with the base wall 111 and the peripheral wall 112 of the flow path forming member 101, the cover member 401 which is bonded to the peripheral wall 112 of the flow path forming member 101, and the base wall 311 and the peripheral wall 312 of the press member 301 which is bonded to the cover member 401. In addition, according to the embodiment, since the supply regulating unit 30 is provided with the plurality of elastic films 201, it can be said that the outer edge portions 213 of the elastic film 201 is respectively surround with the flow path forming member 101, the plurality of press members 301, and the cover member 401.

Incidentally, since a part of the communicating chamber R1 of the supply regulating section 31 is formed by the elastic film 201 which can be elastically deformed, the elastic film 201 is deformed so that a volume of the communicating chamber R1 decreases when a pressure of the communicating chamber R1 becomes low, and the elastic film 201 is displaced so that a volume of the communicating chamber R1 increases when a pressure in the communicating chamber R1 becomes high. In addition, in a case in which an outflow amount of liquid is larger than an inflow amount in the communicating chamber R1, a pressure of the communicating chamber R1 becomes low, and in a case in which the outflow amount is smaller than the inflow amount of liquid in the communicating chamber R1, a pressure of the communicating chamber R1 becomes high.

Accordingly, in the liquid ejecting apparatus 10, it is possible to control a displacement amount of the elastic film 201 by controlling an inflow amount and an outflow amount of liquid in the communicating chamber R1 of the supply regulating section 31. Specifically, it is possible to switch from a supply permitting state to a supply regulating state by closing the outflow port 114 of the supply regulating section 31 using the elastic film 201, by setting an outflow amount of liquid in the communicating chamber R1 of the supply regulating section 31 to be larger than an inflow amount. In addition, it is possible to switch from the supply regulating state to the supply permitting state by opening the outflow port 114 of the supply regulating section 31, by setting an inflow amount in the communicating chamber R1 of the supply regulating section 31 to be larger than an outflow amount.

On the other hand, it is also possible to set the supply regulating section 31 to the supply regulating state, by pressurizing the center portion 211 of the elastic film 201 from the outer side of the communicating chamber R1 so that a volume of the communicating chamber R1 is decreased. An external force for pressurizing the elastic film 201 may be operated by pressing the elastic film 201 using some members, or may be operated by pressurizing a gas chamber R3 which is formed by the press member 301 and the elastic film 201 using air.

In a case in which the elastic film 201 is displaced so as to decrease a volume of the communicating chamber R1, a volume of the gas chamber R3 increases, and on the other hand, in a case in which the elastic film 201 is displaced so as to increase the volume of the communicating chamber R1, the volume of the gas chamber R3 decreases. However, since the gas chamber R3 communicate with outside air through the through hole 313 of the press member 301, and the through hole 411 of the cover member 401, there is no case in which a pressure of the gas chamber R3 is changed due to a displacement of the elastic film 201.

An urging direction of the elastic film 201 using the coil spring 501 which is installed between the press member 301 and the elastic film 201 may be determined based on an elastic modulus (easiness in deforming) of the elastic film 201. For example, in a case in which the elastic modulus of the elastic film 201 is high, and the elastic film 201 is rarely deformed, the elastic film 201 may be urged so as to decrease a volume of the communicating chamber R1, in order to increase responsiveness of the elastic film 201 which is associated with a pressure change in the communicating chamber R1. On the other hand, in a case in which the elastic modulus of the elastic film 201 is low, and the elastic film 201 is easily deformed, the elastic film 201 may be urged so as to increase the volume of the communicating chamber R1 so that the elastic film 201 does not carelessly close the outflow port 114 along with a slight pressure change in the communicating chamber R1.

Subsequently, operations of the liquid ejecting apparatus 10 according to the embodiment will be described with reference to FIG. 2.

In the liquid ejecting apparatus 10, in a case in which liquid is ejected toward the medium M, liquid of different types are supplied to the liquid ejecting unit 60 from the liquid storage unit 20 through the first flow path 71, the supply regulating unit 30, the second flow path 72, the pressure buffering unit 40, the third flow path 73, the pressure adjusting unit 50, and the fourth flow path 74. In addition, liquid is ejected toward the medium M from the liquid ejecting section 61 of the liquid ejecting unit 60. In a case in which an ejecting failure of liquid occurs in the liquid ejecting section 61, cleaning (choke cleaning) of the liquid ejecting section 61 is performed in order to settle the ejecting failure of liquid.

In a case in which liquid is ejected from the liquid ejecting section 61, liquid flows in the communicating chamber R1 in a state in which a pressure in the communicating chamber R1 of the supply regulating section 31 of the supply regulating unit 30 is a positive pressure. For this reason, in this case, there is a concern that liquid may leak from the communicating chamber R1 to the gas chamber R3 based on a pressure difference between the communicating chamber R1 and the gas chamber R3.

Here, according to the embodiment, since the peripheral edge portion 212 of the elastic film 201 is pressed to the base wall 111 of the flow path forming member 101 using the press member 301, the peripheral edge portion 212 of the elastic film 201 and the base wall 111 of the flow path forming member 101 are in close contact. For this reason, it is possible to suppress leaking of liquid in the communicating chamber R1 from between the flow path forming member 101 and the elastic film 201 (peripheral edge portion 212).

However, for example, a case in which liquid in the communicating chamber R1 leaks on a path (leakage path) which is denoted by a thick arrow in FIG. 2, when a sealing property between the flow path forming member 101 and the elastic film 201 decreases, in a case of using the liquid ejecting apparatus 10 for a long time, or the like, is taken into consideration. However, according to the supply regulating section 31 according to the embodiment, liquid rarely leaks to the outside of the supply regulating section 31 (supply regulating unit 30) even in such a case, since the outer edge portion 213 of the elastic film 201 is surrounded with the flow path forming member 101, the cover member 401 which is welded along with the flow path forming member 101, and the press member 301 which is welded along with the cover member 401.

According to the embodiment, since the outer edge portion 213 of the elastic film 201 is accommodated in the accommodating chamber R2 which is formed between the flow path forming member 101, the press member 301, and the cover member 401, even when liquid in the communicating chamber R1 leaks from between the elastic film 201 and the flow path forming member 101, the liquid is stored in the accommodating chamber R2. That is, it is possible to prevent liquid which leaks from the communicating chamber R1 from leaking to the outside of the supply regulating section 31. In addition, according to the embodiment, since the cover member 401 is set to be transparent, if liquid which leaks to the accommodating chamber R2 is colored liquid, it is possible to observe a state thereof through the cover member 401.

Since the above described accommodating chamber R2 is independently formed in each type of liquid which flows in the supply regulating section 31, it is possible to prevent liquid of different types from being mixed when liquid which leaks to one accommodating chamber R2 in the plurality of accommodating chambers R2 moves to another accommodating chamber R2.

According to the embodiment, it is possible to obtain the following effects.

(1) In the supply regulating section 31 (an example of flow path member), since the outer edge portion 213 of the elastic film 201 is surround with the flow path forming member 101 and the cover member 401, it is possible to prevent liquid from leaking to the outside of the supply regulating section 31, even when the liquid leaks from the communicating chamber R1 through the flow path forming member 101 and the peripheral edge portion 212 of the elastic film 201 therebetween.

(2) It is possible to provide the plurality of communicating chambers R1 in which liquid flow using a single flow path forming member 101 and a single cover member 401. Meanwhile, it is possible to individually position the plurality of elastic films 201 with respect to the flow path forming member 101, by providing the plurality of elastic films 201. That is, it is possible to increase a positioning accuracy of the plurality of elastic films 201 with respect to the flow path forming member 101.

(3) It is possible to cause the elastic film 201 and the flow path forming member 101 to be in close contact, using the press member 301, by providing the press member 301 which presses the elastic film 201 toward the flow path forming member 101. For this reason, it is not necessary to bond the flow path forming member 101 and the elastic film 201 using heat welding, adhesion, or the like. That is, it is possible to relieve a concern that a sealing property between the flow path forming member 101 and the elastic film 201 may deteriorate due to a secular change, compared to a case in which the flow path forming member 101 and the elastic film 201 are subjected to heat welding or adhesion.

(4) The outer edge portion 213 of the elastic film 201 is surrounded with the cover member 401, the flow path forming member 101, and the press member 301, the cover member 401 and the flow path forming member 101 are bonded to each other, and the cover member 401 and the press member 301 are bonded to each other. For this reason, even when liquid leaks from the outer edge portion 213 of the elastic film 201, since a leaking destination of the liquid is closed by using the flow path forming member 101, the cover member 401, and the press member 301, it is possible to further suppress leaking of liquid to the outside of the supply regulating section 31. In other words, according to the embodiment, since a leakage path of liquid from the communicating chamber R1 is closed by using the bonding portions J1 and J2, it is possible to suppress leaking of liquid to the outside of the supply regulating section 31.

(5) It is possible to view the inside of the accommodating chamber R2 by seeing through the cover member 401, by setting the cover member 401 to be transparent. For this reason, it is possible to view leaking of color liquid in the accommodating chamber R2 from the outer edge portion 213 of the elastic film 201, from the outside of the supply regulating section 31.

(6) The plurality of supply regulating sections 31 are provided in the supply regulating unit 30, and the accommodating chamber R2 which surrounds the outer edge portion 213 of the elastic film 201 of the supply regulating section 31 is formed in each of the plurality of supply regulating sections 31. For this reason, even in a case in which liquid leaks from the communicating chamber R1 of one supply regulating section 31 to the accommodating chamber R2, and liquid leaks from the communicating chamber R1 of another supply regulating section 31 to the accommodating chamber R2, in the plurality of supply regulating sections 31, it is possible to suppress leaked liquid are mixed with each other.

The above described embodiment can be changed as denoted below.

The supply regulating section 31 may be set to supply regulating sections 32 to 39 which are illustrated in FIGS. 4 to 11. When describing the supply regulating sections 32 to 39 which are illustrated in FIGS. 4 to 11, configurations of members which are common to those in the above described embodiments are given the same reference numerals, and description thereof will be omitted.

First, a supply regulating section 32 according to a first modification example will be described with reference to FIG. 4. In the supply regulating section 32 according to the first modification example, shapes of a flow path forming member 102 and a press member 302 are different in a case of being compared with the supply regulating section 31 according to the above described embodiment.

Figure 4:
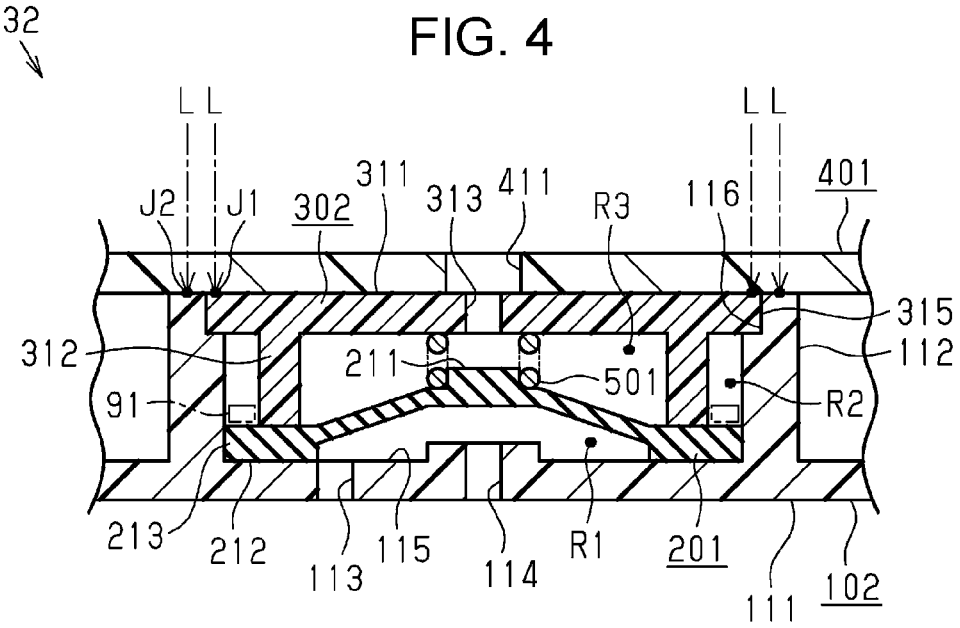
FIG. 4 is a sectional view of a supply regulating unit according to a first modification example.

As illustrated in FIG. 4, the supply regulating section 32 is provided with a flow path forming member 102, the elastic film 201, a press member 302, the cover member 401, and a coil spring 501. A diameter expanding portion 116 in which an outer diameter is enlarged compared to an inner diameter of a peripheral wall 112 is formed at a tip end portion of the peripheral wall 112 of the flow path forming member 102. A flange portion 315 with an outer diameter which is larger than an outer diameter of a peripheral wall 312 of the press member 302 is formed on the outer side of the press member 302 in a radial direction of the base wall 311. Here, the inner diameter of the diameter expanding portion 116 of the flow path forming member 102, and the outer diameter of the flange portion 315 of the press member 302 are set to be approximately the same, and a length of the diameter expanding portion 116 in an erecting direction of the peripheral wall 112 of the flow path forming member 102, and a length of the flange portion 315 in an erecting direction of the peripheral wall 312 of the press member 302 are set to be approximately the same.

When constructing the supply regulating section 32, the elastic film 201 is accommodated in a recessed portion 115 of the flow path forming member 102, and the coil spring 501 is disposed on the elastic film 201. Subsequently, the press member 302 is disposed on the elastic film 201 while causing the flange portion 315 of the press member 302 to be engaged with the diameter expanding portion 116 of the flow path forming member 102. In addition, the cover member 401 is disposed on the peripheral wall 112 of the flow path forming member 102 and a base wall 311 of the press member 302.

Thereafter, the press member 302 and the cover member 401 are bonded by radiating the laser light L to a contact face between the press member 302 and the cover member 401 (first bonding process), and the flow path forming member 102 and the cover member 401 are bonded by radiating the laser light L to a contact face between the flow path forming member 102 and the cover member 401 (second bonding process).

According to the first modification example which is illustrated in FIG. 4, it is possible to obtain the effect in the above described embodiment. In addition, since the flange portion 315 of the press member 302 is engaged with the diameter expanding portion 116 of the flow path forming member 102, it is possible to increase a positioning accuracy of the press member 302 with respect to the flow path forming member 102.

As denoted by a two-dot dashed line in FIG. 4, a detecting unit 91 which detects leaking of liquid in the accommodating chamber R2 may be provided. Since it is possible to cause the detecting unit 91 to detect leaking of liquid in this manner, for example, it is possible to cause a user of the liquid ejecting apparatus 10, or the liquid ejecting apparatus 10 itself to perform an operation for managing leaking of liquid, or the like. In addition, the detecting unit 91 may be provided in the accommodating chamber R2, or the outside of the accommodating chamber R2.

As an example, the detecting unit 91 may have a configuration in which the detecting unit radiates light to a position in the accommodating chamber R2 in which liquid can be leaked, and detects leaking of liquid based on a change in a state of light (for example, reflectivity, or light quantity of reflected light) between a leaking time and a non-leaking time. In addition, it may be a configuration in which two electrodes are provided in the accommodating chamber R2, and leaking of liquid is detected based on a current value between the two electrodes which is changed between a leaking time and a non-leaking time. In addition, it may be a configuration in which leaking of liquid is detected based on a pressure change in the communicating chamber R1 or the accommodating chamber R2 between a leaking time and a non-leaking time.

Subsequently, a supply regulating section 33 according to a second modification example will be described with reference to FIG. 5. In a case in which the supply regulating section 33 according to the second modification example is compared with the supply regulating section 31 according to the above described embodiment, a shape of an elastic film 203 is different.

Figure 5:
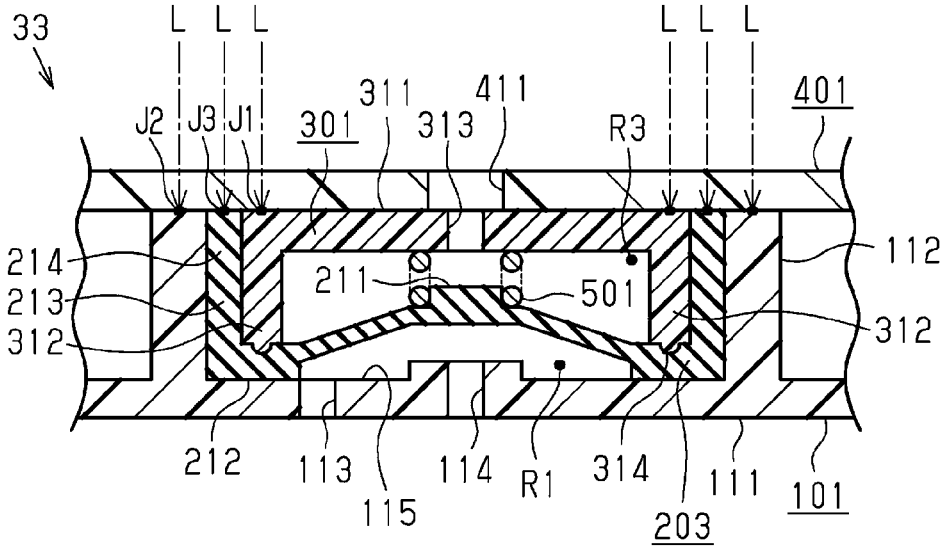
FIG. 5 is a sectional view of a supply regulating unit according to a second modification example.

As illustrated in FIG. 5, the supply regulating section 33 is provided with the flow path forming member 101, the elastic film 203, the press member 301, the cover member 401, and the coil spring 501. The elastic film 203 has an annular peripheral wall 214 which is erected from the peripheral edge portion 212. A height of the peripheral wall 214 of the elastic film 203 in the erecting direction is set to be approximately the same as a height of the peripheral wall 112 of the flow path forming member 101 in the erecting direction. In addition, an outer diameter of the peripheral wall 214 of the elastic film 203 is set to be approximately the same as an inner diameter of the peripheral wall 112 of the flow path forming member 101, and an inner diameter of the peripheral wall 214 of the elastic film 203 is set to be approximately the same as an outer diameter of the peripheral wall 312 of the press member 301.

When constructing the supply regulating section 33, the elastic film 203 is accommodated in the recessed portion 115 of the flow path forming member 101, while causing an outer peripheral face of the peripheral wall 214 of the elastic film 203 to be in contact with an inner peripheral face of the peripheral wall 112 of the flow path forming member 101 in a sliding manner. Subsequently, the coil spring 501 is disposed on the elastic film 203, and the press member 301 is disposed on the elastic film 203, while causing the outer peripheral face of the peripheral wall 312 of the press member 301 to be in contact with the inner peripheral face of the peripheral wall 214 of the elastic film 203 in a sliding manner. In addition, the cover member 401 is disposed on the peripheral wall 112 of the flow path forming member 101, the peripheral wall 214 of the elastic film 203, and the base wall 311 of the press member 301.

Thereafter, the press member 301 and the cover member 401 are bonded by radiating the laser light L to the contact face of the press member 301 and the cover member 401 (first bonding process). In addition, the flow path forming member 101 and the cover member 401 are bonded by radiating the laser light L to the contact face of the flow path forming member 101 and the cover member 401 (second bonding process).

In addition, the elastic film 203 and the cover member 401 are bonded by radiating the laser light L to the contact face of the elastic film 203 and the cover member 401. In the following descriptions, the process in which the elastic film 203 and the cover member 401 are bonded is also referred to as a "third bonding process". In the third bonding process, as denoted by a black spot in FIG. 5, an annular bonding portion J3 which bonds the elastic film 203 and the cover member 401 is generated.

According to the second modification example which is illustrated in FIG. 5, it is possible to obtain the effect in the above described embodiment. Since the peripheral wall 312 of the press member 301 is in contact with the peripheral wall 214 of the elastic film 203 in a sliding manner, when disposing the press member 301 on the elastic film 203, it is possible to increase a positioning accuracy of the press member 301 with respect to the elastic film 203.

Subsequently, a supply regulating section 34 according to a third modification example will be described with reference to FIG. 6. In addition, the supply regulating section 34 according to the third modification example is different in material from a flow path forming member 104, a press member 304, and a cover member 404, in a case of being compared with the supply regulating section 32 according to the first modification example.

Figure 6:
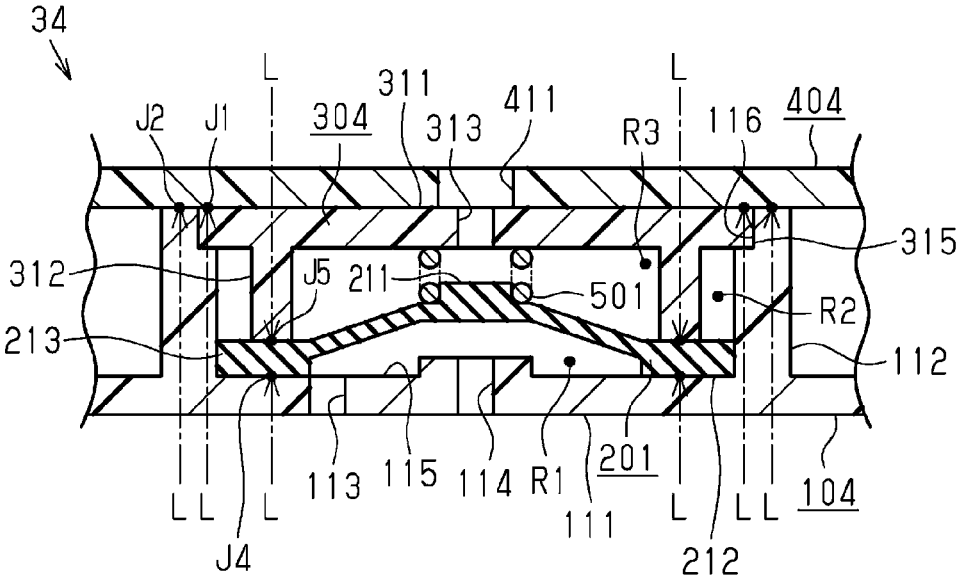
FIG. 6 is a sectional view of a supply regulating unit according to a third modification example.

As illustrated in FIG. 6, the supply regulating section 34 is provided with the flow path forming member 104, the elastic film 201, the press member 304, the cover member 404, and the coil spring 501. The flow path forming member 104 and the press member 304 are transparent, and are set so as to have high transmittance with respect to a wavelength of the laser light L, and the elastic film 201 and the cover member 404 are opaque, and are set so as to have high absorptivity with respect to a wavelength of the laser light L.

When constructing the supply regulating section 34, the elastic film 201 is accommodated in the recessed portion 115 of the flow path forming member 104, and the coil spring 501 is disposed on the elastic film 201. Subsequently, the press member 304 is disposed on the elastic film 201 while causing the flange portion 315 of the press member 304 to be engaged with the diameter expanding portion 116 of the flow path forming member 104.

Thereafter, the flow path forming member 104 and the elastic film 201 are bonded by radiating the laser light L to the contact face of the flow path forming member 104 and the elastic film 201 from the flow path forming member 104 side. In addition, the elastic film 201 and the press member 304 are bonded, by radiating the laser light L to the contact face of the elastic film 201 and the press member 304 from the press member 304 side.

In the following descriptions, a process of bonding the flow path forming member 104 and the elastic film 201 is also referred to as a "fourth bonding process", and a process of bonding the elastic film 201 and the press member 304 is also referred to as a "fifth bonding process". As denoted by a black spot in FIG. 6, a bonding portion J4 which bonds the flow path forming member 104 and the elastic film 201 is generated in the fourth bonding process, and an annular bonding portion J5 which bonds the press member 304 and the elastic film 201 is generated in the fifth bonding process.

In addition, the cover member 404 is disposed on the peripheral wall 112 of the flow path forming member 104, and on the base wall 311 of the press member 304. Thereafter, the press member 304 and the cover member 404 are bonded by radiating the laser light L to a contact face of the press member 304 and the cover member 404 from the flow path forming member 104 side (first bonding process). In addition, the flow path forming member 104 and the cover member 404 are bonded by radiating the laser light L to a contact face of the flow path forming member 104 and the cover member 404 from the flow path forming member 104 side (second bonding process).

In this manner, according to the third modification example, it is possible to obtain the effect in the above described embodiment. In addition, it is possible to secure a sealing property of the communicating chamber R1 and the accommodating chamber R2 without providing the protrusion portion 314 in the press member 304.

Subsequently, a supply regulating section 35 according to a fourth modification example will be described with reference to FIG. 7. The supply regulating section 35 according to the fourth modification example is different from the supply regulating section 31 in the above described embodiment, in a point that a configuration corresponding to the press member 301 is integrated with a cover member 405.

Figure 7:
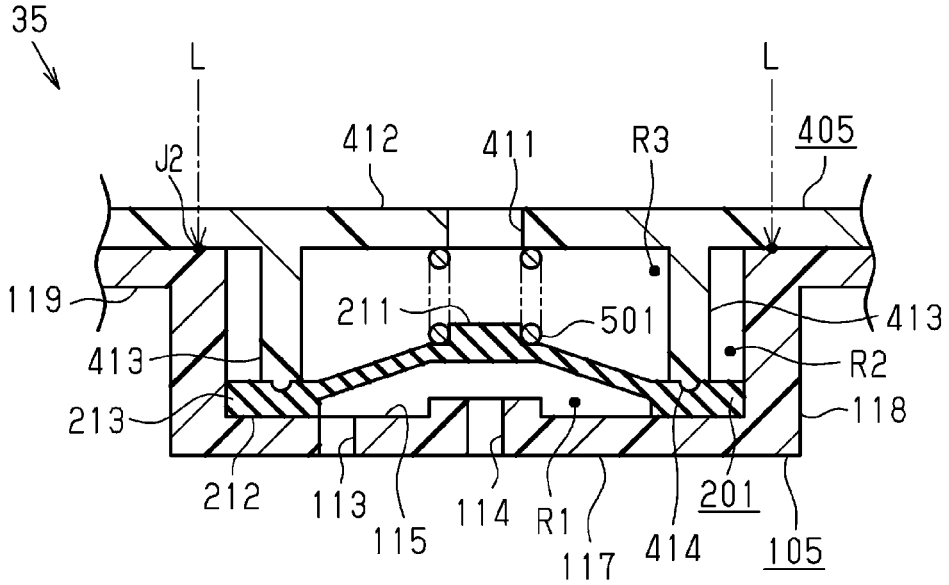
FIG. 7 is a sectional view of a supply regulating unit according to a fourth modification example.

As illustrated in FIG. 7, the supply regulating section 35 is provided with a flow path forming member 105, the elastic film 201, the cover member 405, and the coil spring 501. The flow path forming member 105 is provided with a base wall 117 which is formed in a disk shape, an annular peripheral wall 118 which is erected from a peripheral edge portion of the base wall 117, and a top wall 119 which extends from a tip end of the peripheral wall 118 to the outer side of the peripheral wall 118 in a radial direction.

The cover member 405 is provided with a plate-shaped base wall 412, and an annular peripheral wall 413 which is erected from the base wall 412. An outer diameter of the peripheral wall 413 of the cover member 405 is set to be smaller than an inner diameter of the peripheral wall 118 of the flow path forming member 105. In addition, a protrusion portion 414 is formed in a protruding manner over a peripheral direction on a tip end face of the peripheral wall 413 of the cover member 405.

In addition, when constructing the supply regulating section 35, the elastic film 201 is accommodated in the recessed portion 115 of the flow path forming member 105, and the coil spring 501 is disposed on the elastic film 201. Subsequently, the cover member 405 is disposed on the flow path forming member 105 and the elastic film 201 so that the protrusion portion 414 of the cover member 405 can press the peripheral edge portion 212 of the elastic film 201. In addition, the flow path forming member 105 and the cover member 405 are bonded by radiating the laser light L to a contact face of the flow path forming member 105 and the cover member 405 (second bonding process).

That is, according to the modification example, the elastic film 201 is pressed toward the flow path forming member 105 using the peripheral wall 413 (protrusion portion 414) of the cover member 405. In this point, the peripheral wall 413 of the cover member 405 and the protrusion portion 414 correspond to an example of a "pressing portion" in the modification example.

According to the fourth modification example, it is possible to obtain the effect in the above described embodiment. In addition, since the peripheral wall 413, the protrusion portion 414 are provided in the cover member 405, it is possible to make a configuration of the supply regulating section 35 (flow path member) simple, compared to a case in which the press member 301 is separately provided. In a case of being compared with the first embodiment, it is possible to omit the first bonding process in which the press member 301 and the cover member 401 are bonded.

Figure 8:
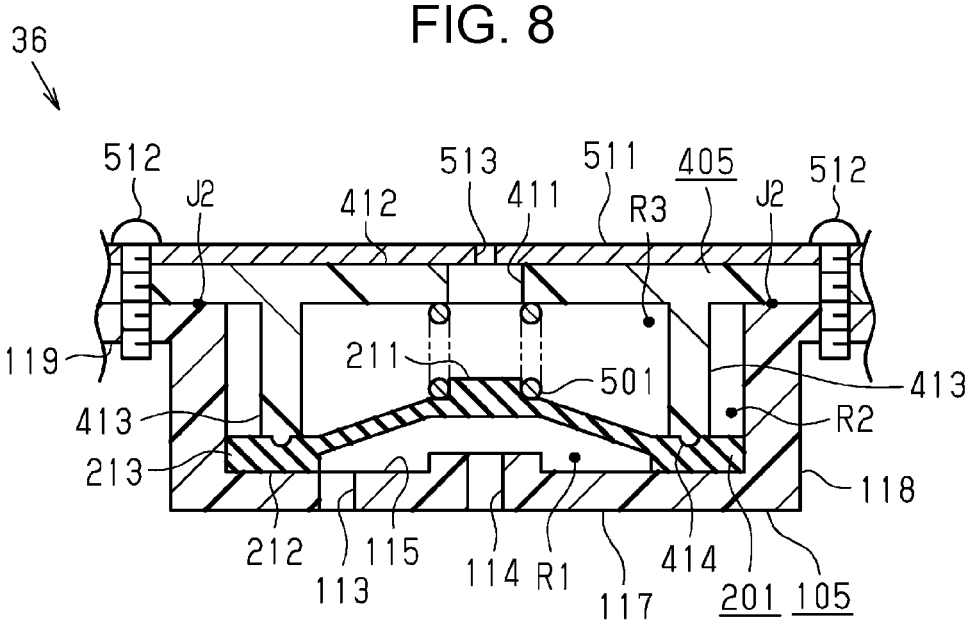
FIG. 8 is a sectional view of a supply regulating unit according to a fifth modification example.

A supply regulating section 36 according to a fifth modification example illustrated in FIG. 8 may be provided, by reinforcing the supply regulating section 35 according to the fourth modification example using a reinforcing plate 511.

That is, as illustrated in FIG. 8, the plate-shaped reinforcing plate 511 is disposed on the cover member 405, and the top wall 119 of the flow path forming member 105, the base wall 412 of the cover member 405, and the reinforcing plate 511 may be fastened by using a fastening member 512 such as a bolt. It is preferable to form a through hole 513 which can communicate with the through hole 411 of the cover member 405 in the reinforcing plate 511.

Subsequently, a supply regulating section 37 according to a sixth modification example will be described with reference to FIG. 9. The supply regulating section 37 according to the sixth modification example is different from the supply regulating section 35 according to the fourth modification example, in a point that there is no coil spring 501, and shapes of a flow path forming member 107 and a cover member 407 are different.

Figure 9:
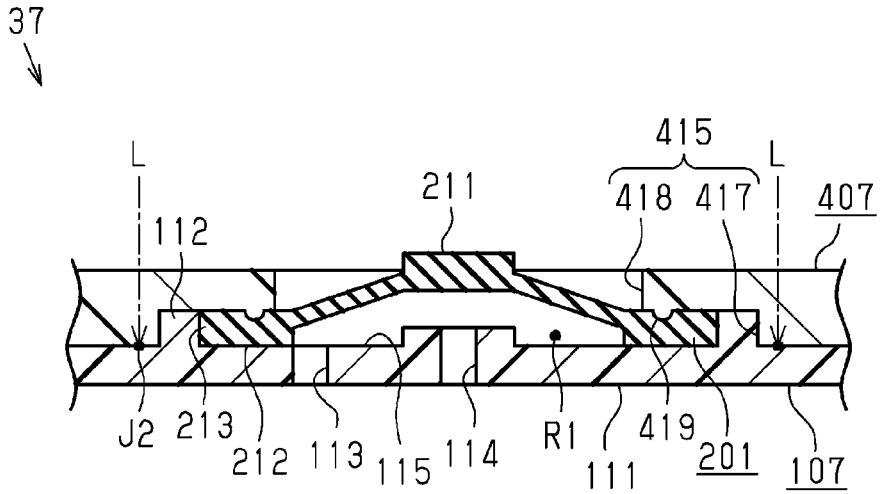
FIG. 9 is a sectional view of a supply regulating unit according to a sixth modification example.

As illustrated in FIG. 9, the supply regulating section 37 is provided with the flow path forming member 107, the elastic film 201, and the cover member 407. The cover member 407 is formed in a plate shape, and in which an accommodating hole 415 for accommodating the elastic film 201 is formed. The accommodating hole 415 includes a large diameter portion 417 with a large hole diameter, and a small diameter portion 418 which communicates with the large diameter portion 417, and has a small hole diameter. In addition, a protrusion portion 419 which protrudes toward an axial direction of the accommodating hole 415 is formed in a protruding manner, in the small diameter portion 418 of the cover member 407 over a peripheral direction of the accommodating hole 415.

In addition, when constructing the supply regulating section 37, the elastic film 201 is accommodated in the recessed portion 115 of the flow path forming member 107. Subsequently, the cover member 407 is disposed on the flow path forming member 107 and the elastic film 201 so that a protrusion portion 419 of the cover member 407 can press the peripheral edge portion 212 of the elastic film 201. In addition, the flow path forming member 107 and the cover member 407 are bonded by radiating the laser light L to a contact face of the flow path forming member 107 and the cover member 407 (second bonding process).

According to the sixth modification example, it is possible to obtain the effect in the above described embodiment.

Subsequently, a supply regulating section 38 according to a seventh modification example will be described with reference to FIG. 10. The supply regulating section 38 according to the seventh modification example is different from the supply regulating section 34 according to the third modification example, in a point that there is no press member 304, and a first flow path 71, and a part of a second flow path 72 are formed inside the flow path forming member 108.

Figure 10:
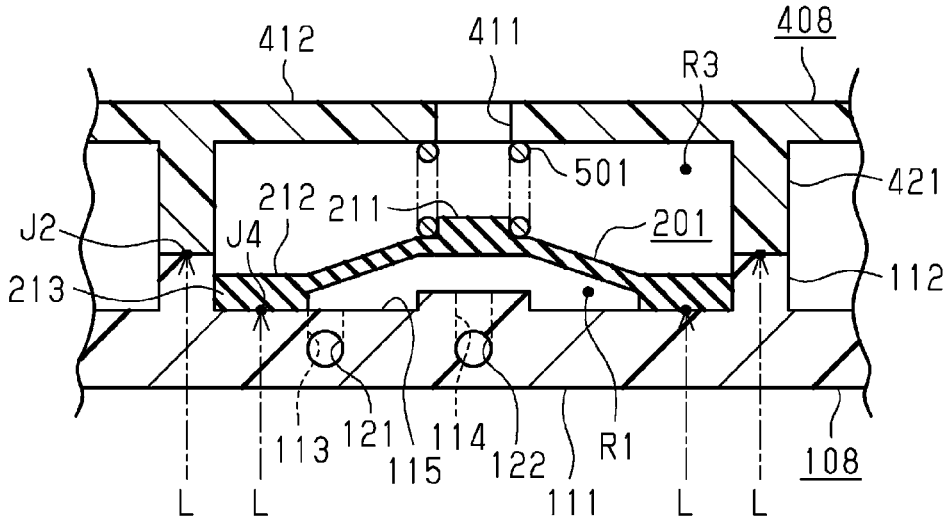
FIG. 10 is a sectional view of a supply regulating unit according to a seventh modification example.

As illustrated in FIG. 10, the supply regulating section 38 is provided with the flow path forming member 108, the elastic film 201, a cover member 408, and a coil spring 501. A first inner flow path 121 which is a part of the first flow path 71, and is connected to the inflow port 113, and a second inner flow path 122 which is a part of the second flow path 72, and is connected to the outflow port 114 are formed on the base wall 111 of the flow path forming member 108. The first inner flow path 121 and the second inner flow path 122 are formed in a direction intersecting the inflow port 113 and the outflow port 114. The cover member 408 includes a base wall 412, and a peripheral wall 421 which is erected from the base wall 412, and is formed in an annular shape. An outer diameter and an inner diameter of the peripheral wall 421 of the cover member 408 are set to be approximately the same as those of the peripheral wall 112 of the flow path forming member 108.

The flow path forming member 108 is set to be transparent, and to have high transmittance with respect to a wavelength of the laser light L, and the cover member 408 is set to be opaque, and to have high absorptivity with respect to the wavelength of the laser light L.

When constructing the supply regulating section 38, the elastic film 201 is accommodated in the recessed portion 115 of the flow path forming member 108, and the coil spring 501 is disposed on the elastic film 201. Subsequently, the cover member 408 is disposed on the flow path forming member 108 so that a tip end face of the peripheral wall 112 of the flow path forming member 108, and a tip end face of the peripheral wall 421 of the cover member 408 are in contact. In addition, the flow path forming member 108 and the cover member 408 are bonded by radiating the laser light L to a contact face of the flow path forming member 108 and the cover member 408 from the flow path forming member 108 side (second bonding process). In addition, the flow path forming member 108 and the elastic film 201 are bonded, by radiating the laser light L to a contact face of the flow path forming member 108 and the elastic film 201 from the flow path forming member 108 side (fourth bonding process).

According to the seventh modification example, it is possible to obtain the effect in the above described embodiment.

Incidentally, as a method of forming a flow path such as the first inner flow path 121 and the second inner flow path 122 in the flow path forming member 108, there is the following method, for example. That is, a flow path groove which communicates with the inflow port 113, and a flow path groove which communicates with the outflow port 114 are provided in the flow path forming member 108 in a recessing manner, the flow path forming member 108 is covered with a film member so as to close these flow path grooves, and the laser light L is radiated to a contact face of the flow path forming member 108 and the film member. In this manner, a flow path which is connected to the inflow port 113 and the outflow port 114 is formed, using the flow path grooves of the flow path forming member 108 and the film member.

Incidentally, since it is necessary to radiate the laser light L from the film member side in this method, it is necessary to form the flow path forming member 108 using a material with high absorptivity with respect to a wavelength of the laser light L, and to form the film member using a material with low absorptivity with respect to the wavelength of the laser light L. In this point, in the supply regulating section 38 according to the seventh modification example, since a flow path is formed inside the flow path forming member 108, there is no limitation in a material of the flow path forming member 108.

In the seventh modification example illustrated in FIG. 10, the through hole 411 may be closed using a filter which permits passing through of gas, and limits passing through of gas, on the other hand. In this manner, it is possible to suppress leaking of liquid to the outer side of the supply regulating section 38 through the through hole 411, even when liquid leaks from the communicating chamber R1 to the gas chamber R3. Meanwhile, in this case, when liquid leaked from the communicating chamber R1 to the gas chamber R3 reaches the filter, it is difficult for the gas to pass through the filter. For this reason, it is possible to determine whether or not the liquid leaked from the communicating chamber R1 to the gas chamber R3 reached the filter, by detecting whether or not there is a pressure change in the gas chamber R3 along with a displacement of the elastic film 201, by providing a pressure sensor in the gas chamber R3.

Subsequently, a supply regulating section 39 according to an eighth modification example will be described with reference to FIG. 11. The supply regulating section 39 according to the eighth modification example is a section which adopts the shape of the flow path forming member 108 of the supply regulating section 38 according to the seventh modification example, in the supply regulating section 37 according to the sixth modification example.

Figure 11:
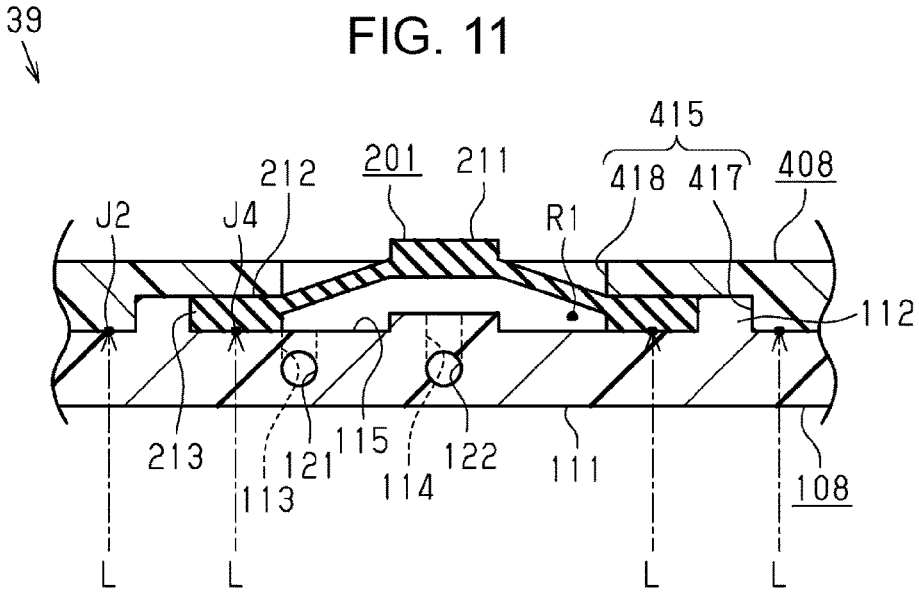
FIG. 11 is a sectional view of a supply regulating unit according to an eighth modification example.

As illustrated in FIG. 11, the supply regulating section 39 is provided with the flow path forming member 108, the elastic film 201, and the cover member 408. In addition, the flow path forming member 108 is set to be transparent, and to have high transmittance with respect to a wavelength of the laser light L, and the cover member 408 is set to be opaque, and to have high absorptivity with respect to the wavelength of the laser light L.

In addition, when constructing the supply regulating section 39, the elastic film 201 is accommodated in the recessed portion 115 of the flow path forming member 108, and the cover member 408 is disposed on the flow path forming member 108 and the elastic film 201. In addition, the flow path forming member 108 and the cover member 408 are bonded by radiating the laser light L to a contact face of the flow path forming member 108 and the cover member 408 from the flow path forming member 108 side (second bonding process). In addition, the flow path forming member 108 and the elastic film 201 are bonded, by radiating the laser light L to a contact face of the flow path forming member 108 and the elastic film 201 from the flow path forming member 108 side (fourth bonding process).

According to the eighth modification example, it is possible to obtain effects of the above described embodiment and the seventh modification example.

Figure 12:
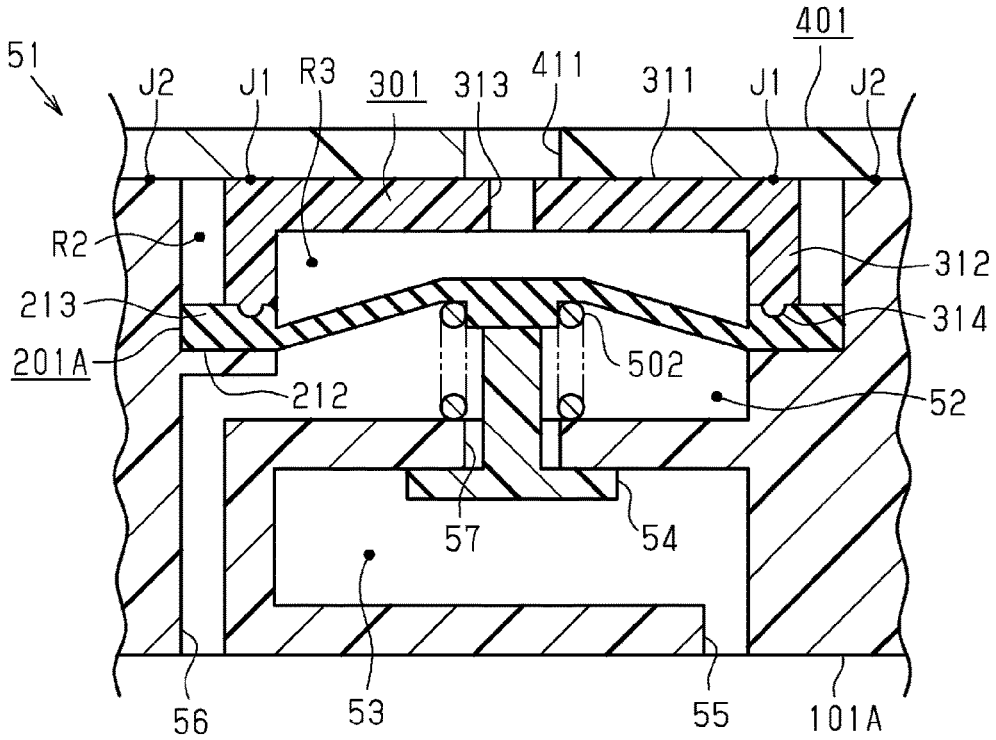
FIG. 12 is a sectional view of a pressure adjusting section of a pressure adjusting unit.

Subsequently, a modification example in which a flow path member is adopted in the pressure adjusting section 51 of the pressure adjusting unit 50 will be described with reference to FIG. 12. Since a manufacturing method of the pressure adjusting section 51 which is illustrated in FIG. 12 is approximately the same as that of the supply regulating section 31 in the above described embodiment, descriptions of the manufacturing method will be omitted. That is, materials of a flow path forming member 101A and an elastic film 201A are set to be the same as those in the above described embodiment.

As illustrated in FIG. 12, the pressure adjusting section 51 includes a pressure chamber 52 which stores liquid, a supply chamber 53 which stores liquid, the elastic film 201A which is elastic, a valve 54 which permits or limits supplying of liquid from the supply chamber 53 to the pressure chamber 52, and a coil spring 502 which urges the elastic film 201A in the pressure chamber 52.

The pressure chamber 52 communicates with an outflow path 56 which is connected to an upstream end of the fourth flow path 74, and the supply chamber 53 communicates with an inflow path 55 which is connected to a downstream end of the third flow path 73. The pressure chamber 52 and the supply chamber 53 communicate with each other through a communicating path 57.

According to the embodiment, the pressure chamber 52 is formed of the flow path forming member 101A and the elastic film 201A, and the supply chamber 53 is formed in the flow path forming member 101A. Here, the elastic film 201A is pressed to the flow path forming member 101A using the press member 301. In addition, the flow path forming member 101A and the press member 301 are bonded to the cover member 401.

The valve 54 is provided over the pressure chamber 52 and the supply chamber 53 through the communicating path 57, and is bonded to the elastic film 201A. For this reason, the valve 54 is displaced along with the elastic film 201A, in a case in which the elastic film 201A is displaced.

The coil spring 502 urges the elastic film 201A so that the valve 54 which is integrated with the elastic film 201A closes an opening on the supply chamber 53 side of the communicating path 57. For this reason, in a case in which a pressure of the gas chamber R3 on the outer side of the pressure chamber 52 is an atmospheric pressure, a pressure in the pressure chamber 52 and the outflow path 56 becomes a pressure less than the atmospheric pressure. In the following descriptions, a pressure in the pressure chamber 52 when the valve 54 closes the opening of the communicating path 57 is referred to as a "reference pressure".

When liquid is ejected toward the medium M from the nozzle 62 of the liquid ejecting section 61, liquid of an amount which is consumed in the liquid ejecting section 61 is supplied from the pressure chamber 52 which communicates with the nozzle 62 of the liquid ejecting section 61. As a result, a pressure in the pressure chamber 52 decreases, and the elastic film 201A is displaced so that a volume of the pressure chamber 52 is decreased.

In addition, when the pressure in the pressure chamber 52 is decreased so as to be less than the reference pressure, the pressure chamber 52 and the supply chamber 53 communicate, when the valve 54 which is pressed by the elastic film 201A opens the communicating path 57 while compressing the coil spring 502. Here, since the supply chamber 53 is in a state of a pressure higher than the reference pressure, while the pressure chamber 52 is in a state of a pressure less than the reference pressure, liquid flows into the pressure chamber 52 from the supply chamber 53 through the communicating path 57.

Subsequently, when a state in which a flow rate of liquid which flows into the pressure chamber 52 (flow rate of liquid supplied from supply chamber 53) exceeds a flow rate of liquid which flows out from the pressure chamber 52 (flow rate of liquid supplied to liquid ejecting section 61) is continued, a pressure in the pressure chamber 52 gradually increases, and the elastic film 201A is displaced so that the volume of the pressure chamber 52 is increased. In addition, when the pressure in the pressure chamber 52 becomes high so as to be the reference pressure or more, the pressure chamber 52 and the supply chamber 53 do not communicate, since the valve 54 in which a restoring force of the coil spring 502 is operated closes the communicating path 57.

In this manner, the pressure adjusting section 51 permits supplying of liquid to the liquid ejecting section 61 side in a case in which the pressure in the pressure chamber 52 is less than the reference pressure. On the other hand, the pressure adjusting section 51 limits supplying of liquid to the liquid ejecting section 61 side in a case in which the pressure in the pressure chamber 52 is the reference pressure or more. In this manner, the pressure adjusting section 51 adjusts a pressure of liquid which is supplied to the liquid ejecting section 61.

At a time of performing choke cleaning, or the like, there is a case in which a pressure in the pressure chamber 52 becomes a positive pressure, when a state in which the valve 54 of the pressure adjusting section 51 opens the communicating path 57 is continued. For this reason, according to the pressure adjusting section 51 illustrated in FIG. 12, it is possible to obtain the same effect as that in the above described embodiment in the pressure adjusting section 51. In addition, in the pressure adjusting section 51, the inflow path 55, the supply chamber 53, the communicating path 57, the pressure chamber 52, and the outflow path 56 correspond to the "flow path".

Subsequently, a modification example in which a flow path member is applied to the pressure buffering section 41 of the pressure buffering unit 40 will be described with reference to FIG. 13. Since a manufacturing method of the pressure buffering section 41 which is illustrated in FIG. 13 is approximately the same as that of the supply regulating section 31 in the above described embodiment, descriptions of the manufacturing method will be omitted.

Figure 13:
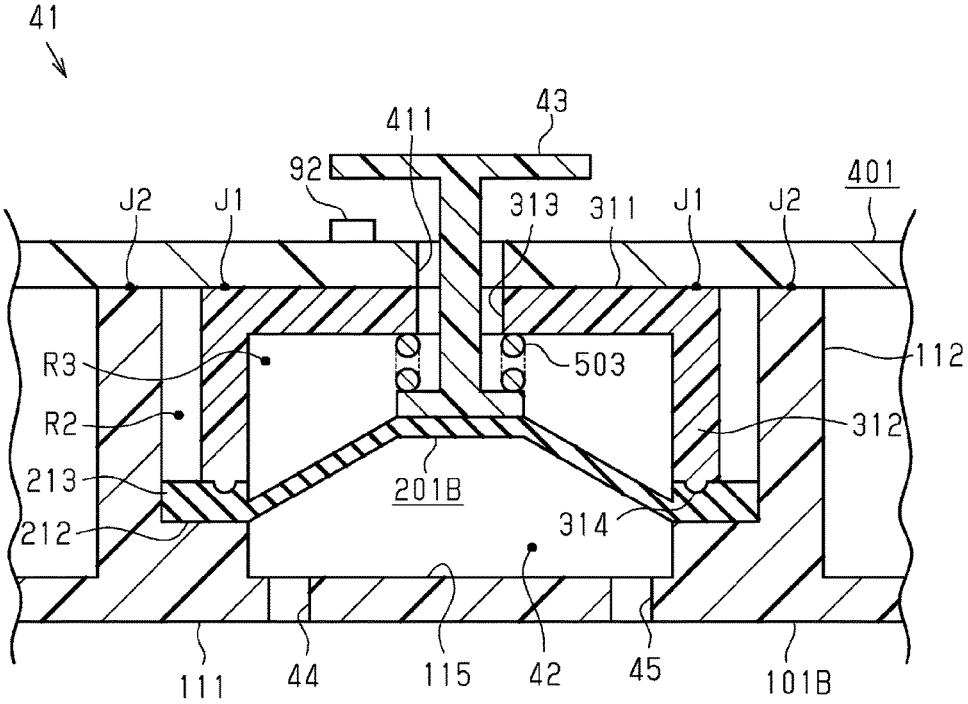
FIG. 13 is a sectional view of a pressure buffering section of a pressure buffering unit.

As illustrated in FIG. 13, the pressure buffering section 41 includes a storage chamber 42 which stores liquid, an elastic film 201B which is elastic, a moving object 43 which moves according to a displacement of the elastic film 201B, a coil spring 503 which urges the moving object 43 toward the elastic film 201B, and a detecting unit 92 which detects a contact state with the moving object 43.

The storage chamber 42 is formed of the flow path forming member 101B and the elastic film 201B. In addition, an inflow port 44 which communicates with the second flow path 72, and an outflow port 45 which communicates with the third flow path 73 communicate with the storage chamber 42. That is, since liquid which is pressurized is supplied from the liquid storage section 21 to the storage chamber 42, a pressure in the storage chamber 42 becomes a positive pressure. In addition, the elastic film 201B is pressed to the flow path forming member 101B due to the press member 301. In addition, the flow path forming member 101B and the press member 301 are bonded to the cover member 401.

The moving object 43 protrudes from the cover member 401 though the through hole 313 of the press member 301 and the through hole 411 of the cover member 401. The detecting unit 92 is provided on the cover member 401 so as to be located between the portion protrudes from the cover member 401 of the moving object 43 and the cover member 401.

In a case in which liquid is ejected toward the medium M from the nozzle 62 of the liquid ejecting section 61, liquid of an amount consumed in the liquid ejecting section 61 is supplied from the liquid storage section 21, and accordingly, the elastic film 201B of the pressure buffering section 41 is not displaced much, and liquid flows in the storage chamber 42.

On the other hand, in a case in which liquid of a large amount is temporarily consumed in the liquid ejecting section 61, and a consumed amount of liquid in the liquid ejecting section 61 exceeds a supply amount of liquid from the liquid storage section 21, there is a concern that liquid to be ejected may become insufficient, and an ejecting failure of liquid may occur in the liquid ejecting section 61. In this point, according to the pressure buffering section 41, an occurrence of ejecting failure of liquid is suppressed, by supplying a shortage which is obtained by subtracting a supply amount from a consumed amount from the storage chamber 42. In addition, in this case, a volume of the storage chamber 42 temporarily decreases, since the above described shortage is supplied; however, a storage amount of liquid in the storage chamber 42 is gradually restored along with decreasing in consumed amount of liquid in the liquid ejecting section 61. That is, in this case, the moving object 43 and the detecting unit 92 are rarely in contact, due to a displacement of the moving object 43 which is associated with a displacement of the elastic film 201B.

In a case in which liquid is supplied toward the liquid ejecting section 61 from the liquid storage section 21 using a diaphragm pump, or the like, a supply voltage of liquid becomes easily unstable due to pulsation of the pump. In this point, according to the embodiment, it is possible to prevent a voltage of liquid which is supplied to the downstream side of the pressure buffering section 41 from fluctuating, since the elastic film 201B is displaced so as to negate the pulsation of the pump.

In a case in which it is not possible to supply liquid of an amount corresponding to a consumed amount of liquid in the liquid ejecting section 61, since residual liquid in the liquid storage section 21 decreases, liquid is supplied to the downstream side from the storage chamber 42 of the pressure buffering section 41. Here, since liquid is not supplied to the pressure buffering section 41, a volume of the storage chamber 42 is gradually decreased. As a result, since the moving object 43 is displaced along with a displacement of the elastic film 201B, the moving object 43 and the detecting unit 92 are in contact. In this manner, it is possible to detect that there is no residual liquid (decreased) in the liquid storage section 21 using the detecting unit 92 which is provided in the pressure buffering section 41.

According to the pressure buffering section 41 illustrated in FIG. 13, it is possible to obtain the effect in the above described embodiment, in the pressure buffering section 41. In the pressure buffering section 41, the inflow port 44, the storage chamber 42, and the outflow port 45 correspond to the "flow path".

In the above described embodiment, the flow path forming member 101 and the cover member 401, and the press member 301 and the cover member 401 may not be bonded by using radiating of the laser light L. For example, the flow path forming member 101 and the cover member 401, and the press member 301 and the cover member 401 may be bonded by using heat welding, or the flow path forming member 101 and the cover member 401, and the press member 301 and the cover member 401 may be bonded using adhesion in which an adhesive, or the like, is used. In addition, each member may be bonded, by combining a plurality of bonding methods. The same is applied to the above described each modification example.

In the above described embodiment, a supply regulating unit which includes a single supply regulating section 31 may be formed, by including the flow path forming member 101, the elastic film 201, the press member 301, and the cover member 401. The same is applied to the above described each modification example.

In the above described embodiment, all of the flow path forming member 101, the press member 301, and the cover member 401 may be set to be transparent, provided that the flow path forming member 101 and the cover member 401, and the press member 301 and the cover member 401 can be bonded.

In the above described embodiment, a part of the second flow path 72 which communicates with the inflow port 113 may be formed, or a part of the third flow path 73 which communicates with the outflow port 114 may be formed, by providing the flow path groove which communicates with the inflow port 113 and the outflow port 114 in a recessing manner, on the base wall 111 of the flow path forming member 101, and bonding a film to the base wall 111. The same is applied to the above described each modification example.

The supply regulating unit 30, the pressure buffering unit 40, and the pressure adjusting unit 50 may be integrally formed. That is, the flow path forming member 101 of the supply regulating unit 30, the flow path forming member 101B of the pressure buffering unit 40, and the flow path forming member 101A of the pressure adjusting unit 50 may be set to the same member.

The liquid ejecting apparatus 10 may be a so-called serial head printer which performs printing of one pass by causing ink to be ejected toward a medium M, while causing the liquid ejecting section 61 to reciprocate in a width direction of the medium M. In addition, the liquid ejecting apparatus 10 may be a line head printer which performs printing by causing ink to be ejected from the liquid ejecting section 61 with a length corresponding to a length of a medium M in the width direction.

The medium M is not limited to a sheet, may be a plastic film, a thin plate material, or the like, cloth used in a textile printing apparatus, or the like, clothing such as a T-shirt, or a three-dimensional object such as stationery, or tableware.

Liquid ejected by the liquid ejecting section 61 is not limited to ink, and may be, for example, a liquid body which is obtained when particles of a functional material are dispersed or mixed in liquid, or the like. It may be a configuration in which recording is performed by ejecting a liquid body including a material such as an electrode material which is used in manufacturing of a liquid crystal display, an electroluminescence (EL) display, a surface light emitting display, or the like, or a coloring material (pixel material), for example, in a form of dispersion or dissolution.

Subsequently, technical ideas which can be grasped from the above described embodiment and the modification examples will be additionally described below.

A manufacturing method of a flow path member is a method in which a flow path forming member, an elastic film which forms a flow path in a state in which a peripheral edge portion is in close contact with the flow path forming member, and a cover member which is bonded to the flow path forming member, and surrounds an outer edge portion of the elastic film along with the flow path forming member are provided. The manufacturing method of the flow path member includes a bonding process in which the flow path forming member and the cover member are bonded, by radiating laser light L to a portion in which the flow path forming member and the cover member are in contact.

The entire disclosure of Japanese Patent Application No. 2015-190941, filed Sep. 29, 2015 is expressly incorporated by reference herein.

What is claimed is:

1. A flow path member comprising:

a flow path forming member;

an elastic film which forms a liquid flow path for flowing liquid in a state in which a peripheral edge portion is in close contact with the flow path forming member, the elastic film being configured to separate the liquid flow path and outside air;

a press member which presses the elastic film toward the flow path forming member;

a cover member which surrounds an outer edge portion of the elastic film along with the flow path forming member and the press member; and an urging member which is provided between the press member and the elastic film, the urging member being configured to urge the elastic film toward the flow path forming member, wherein the flow path forming member and the press member are in contact with a first surface of the cover member.

2. The flow path member according to claim 1,
wherein a plurality of the elastic films are provided,
wherein the plurality of elastic films form a plurality of flow paths, in a state in which respective peripheral edge portions are in close contact with the flow path forming member, individually,
wherein a plurality of press members press the plurality of elastic films, individually, and wherein the cover member surrounds the outer edge portions of the plurality of elastic films, individually, along with the flow path forming member and the plurality of press members.

3. The flow path member according to claim 1,
wherein the flow path forming member and the press member are bonded to the first surface of the cover member.

4. The flow path member according to claim 1,
wherein at least one of the flow path forming member and the cover member is transparent.

5. A liquid ejecting apparatus comprising:
a liquid ejecting section which ejects liquid; and
a liquid supplying flow path which supplies liquid to the liquid ejecting section,
wherein the liquid supplying flow path includes the flow path member according to claim 1.

6. The liquid ejecting apparatus according to claim 5, further comprising:
a detecting unit which detects leaking of liquid from the outer edge portion of the elastic film.

7. The flow path member according to claim 1,
wherein the elastic film and the cover member have high absorptivity in the wavelength range of a laser light,
wherein the flow path forming member has high transmittance in the wavelength range of the laser light,
wherein each of the elastic film and the cover member has a surface facing the flow path forming member, and
wherein the surface of the elastic film and the surface of the cover member are bonded to the flow path forming member.

8. The flow path member according to claim 1, wherein the outer edge portion of the elastic film is accommodated in a sealed space surrounded by the flow path forming member, the cover member, and the press member.

9. The flow path member according to claim 1,
wherein the cover member has a through hole,
wherein the through hole is located at a position overlapping a region inside a region where the press member presses the elastic film.

10. The flow path member according to claim 9, wherein the press member has a passage communicating with the through hole.

11. The flow path member according to claim 3, wherein the cover member has a through hole in a region inside a region bonded to the press member.

12. The flow path member according to claim 1, wherein the flow path forming member includes a recess portion for accommodating the elastic film and the press member, and wherein an outer edge portion of a portion of the press member in contact with the elastic film is provided away from the flow path forming member.

13. The flow path member according to claim 12, wherein the outer edge portion of the portion of the press member in contact with the elastic film is disposed inside the outer edge portion of the elastic film.

14. The flow path member according to claim 1, wherein the elastic film and the press member are accommodated into a recess portion provided in the flow path forming member, and wherein an outer edge portion of a portion of the press member in contact with the elastic film is disposed inside the outer edge portion of the elastic film.

15. The flow path member according to claim 13, wherein the cover member has a through hole and wherein the through hole is located at a position overlapping a region inside a region where the press member in contact with the elastic film.

16. The flow path member according to claim 15, wherein the press member has a passage communicating with the through hole.

17. The flow path member according to claim 14, wherein the cover member has a through hole and wherein the through hole is located at a position overlapping a region inside a region where the press member in contact with the elastic film.

18. The flow path member according to claim 17, wherein the press member has a passage communicating with the through hole.

* * * * *